US008230522B1

(12) United States Patent
Bell

(10) Patent No.: US 8,230,522 B1
(45) Date of Patent: Jul. 31, 2012

(54) GLOVES WITH ATTACHED ILLUMINATION MEANS

(76) Inventor: Lucas G. Bell, Moreno Valley, CA (US)

( * ) Notice: Subject to any disclaimer, the term of this patent is extended or adjusted under 35 U.S.C. 154(b) by 1078 days.

(21) Appl. No.: 12/082,120

(22) Filed: Apr. 9, 2008

Related U.S. Application Data

(60) Provisional application No. 60/922,305, filed on Apr. 9, 2007.

(51) Int. Cl.
*A41D 19/00* (2006.01)

(52) U.S. Cl. ..... 2/160

(58) Field of Classification Search ..... 2/160, 161.1, 2/161.6
See application file for complete search history.

(56) References Cited

U.S. PATENT DOCUMENTS

| | | | | |
|---|---|---|---|---|
| 5,124,892 | A | 6/1992 | Lambert | |
| 5,345,368 | A | 9/1994 | Huff | |
| 5,535,105 | A | 7/1996 | Koenen et al. | |
| 6,592,235 | B1 | 7/2003 | Mayo | |
| 6,709,142 | B2 | 3/2004 | Gyori | |
| 6,892,397 | B2 * | 5/2005 | Raz et al. | 2/160 |
| 6,902,289 | B1 | 6/2005 | Smith | |
| 2006/0139911 | A1 * | 6/2006 | Wilkings | 362/103 |
| 2006/0146517 | A1 * | 7/2006 | Park | 362/103 |
| 2008/0130268 | A1 * | 6/2008 | Johnson et al. | 362/103 |
| 2008/0218996 | A1 * | 9/2008 | Galloway et al. | 362/103 |

* cited by examiner

*Primary Examiner* — Katherine Moran
(74) *Attorney, Agent, or Firm* — Montgomery Patent & Design, LLC; Robert C. Montgomery; Joseph Yaksich

(57) ABSTRACT

A pair of work gloves with an attached directional illumination device is disclosed. A miniature illumination device is affixed thereto the back of the hand area of the work glove via hook-and-loop fasteners. The lighting device takes the form of a small enclosure that houses batteries and a lens with a reflected array of forward facing high-intensity light emitting diodes (LED's). A pushbutton switch is located on top of the case for on/off operation. In use, the apparatus provides a high level of illumination directly in front of the person's hands allowing use while working at night, when light levels are low, as well as in cramped areas where nearby objects restrict the effectiveness of remote lighting devices. The invention is especially valuable in situations where it is impossible to hold a flashlight such as when one needs both hands to perform work.

18 Claims, 4 Drawing Sheets

GLOVES WITH ATTACHED ILLUMINATION MEANS

RELATED APPLICATIONS

The present invention was first described in and claims the benefit of U.S. Provisional Application No. 60/922,305 filed on Apr. 9, 2007, the entire disclosures of which are incorporated herein by reference.

FIELD OF THE INVENTION

The present invention relates generally to an illumination device detachably mounted thereto a glove or a pair of gloves to provide an illumination means thereto a wearer when worn and activated, said gloves may be provided in a half-finger or a full-finger embodiment

BACKGROUND OF THE INVENTION

The "Do-it-Yourself" trend has triggered the development of a broad range of tools and accessories, books, television programs and websites for sectors such as home repair, auto care and repair, crafts and decorations and gardening. The sectors that have taken off the most are that of home and auto repair.

While performing these types of tasks, it is not uncommon for the Do-it-Yourselfer to perform a manual task in an area of limited light that requires the use of both hands. However, attempting to use a flashlight while working with both hands becomes quite a challenge. Typically this means having to try and balance the flashlight under one's chin, hold it in one's mouth, or sit it upon a nearby object to allow the use of both hands to perform the task while having the necessary light to see properly.

Accordingly, there exists a need for a means by which temporary task lighting can be provided in the area immediately around a user's hands without the inherent disadvantages. The development of the invention herein described fulfills this need.

U.S. Pat. No. 6,902,289 filed by Smith discloses an illuminated hand cover assembly. This patent does not appear to disclose a half-finger glove with a removable attachable illumination means.

U.S. Pat. No. 6,892,397 filed by Raz discloses a glove with an integrated light. This patent does not appear to disclose a half-finger glove with a removable attachable illumination means.

U.S. Pat. No. 6,709,142 filed by Gyori discloses a night-time glove. This patent does not appear to disclose a half-finger glove with a removable attachable illumination means.

U.S. Pat. No. 6,592,235 filed by Mayo discloses a light emitting glove. This patent does not appear to disclose a half-finger glove with a removable attachable illumination means nor does this patent appear to disclose a removably attached light source located on the dorsal surface of the glove.

U.S. Pat. No. 5,535,105 filed by Koenen discloses a work glove and illuminator assembly. This patent does not appear to disclose a disclose a half-finger glove with a removable attachable illumination means nor does this patent appear to disclose a removably attached light source located on the dorsal surface of the glove.

U.S. Pat. No. 5,345,368 filed by Huff discloses a hand-mounted illuminating device. This patent does not appear to disclose a clam shell shaped illumination device that is removably attached and that provides a conical light pattern.

U.S. Pat. No. 5,124,892 filed by Lambert discloses a hand-mounted aviation night vision illuminating device. This patent does not appear to disclose a half-finger glove with a removable attachable illumination means.

The prior art appears to disclose various illumination devices designed to be affixed to a user's hand or fingers. The prior art does not appear to disclose a half-finger glove with a removably attached illumination device.

SUMMARY OF THE INVENTION

In view of the foregoing disadvantages inherent in the prior art, it has been observed that there is need for a glove with attached illumination that provides a light beam without the need to hold the illumination device such as in a case of conventional flashlights and trouble lights.

The gloves with attached illumination device may be available as a half-finger glove embodiment or full-finger glove embodiment with an illumination device removably attached.

An object of the present invention comprises a two-piece enclosure which further comprises light sources, a battery compartment, an ON/OFF switch, and a reflective surface that is utilized to illuminate an area in front of the respective hand member.

A further object of the present invention provides for the light sources to be operated by the ON/OFF switch allowing electrical communication with said light sources to emit the light beam. The illumination device is removably attached thereto a back surface of the half-finger glove to project the light beam toward a work area. In this fashion, the illumination device is securely retained thereupon being isolated therefrom movement transmitted therefrom the finger portions of the hand member, thereby providing a steady light beam. The illumination device may be affixed interchangably on either or both left or right hand configurations of the half-finger glove.

A further object of the present invention provides for the illumination device to comprise a two-piece "clamshell" design made of plastic in an injection molding process. The illumination device may be supplied with the gloves or individually as a separate kit for adding thereto an existing glove. The glove material is envisioned to be made that of cloth, rubber, or other materials of elastic properties.

Yet another object of the present invention comprises a half-finger glove with an affixed illumination device. The half-finger glove is envisioned to be shaped in a form of a conventional human hand member comprising five (5) digit areas extending from a central palm and backside areas of the hand member. The half-finger glove provides an attachment means to an elastic cylindrical-shaped band extending around a user's wrist area having a conventional circular aperture to removably receive a hand member.

Still yet another object of the present invention provides for an elastic band as a sewn attachment thereto the half-finger glove around a lower perimeter edge using conventional textile sewing techniques snuggly fitting against the wrist portion of the hand member. The half-finger glove provides protection and permits bending movements in conjunction with the user's hand member while providing a taut envelope thereon. The half-finger glove comprises an elastic material allowing stretching for easy insertion of hand members conforming to the shape and bending movements of the hand member.

Another aspect of the present invention provides for the half-finger glove to comprise digit openings on each end such that the digits of the hand member may extend outwardly, thus providing enhanced tactile feedback. The half-finger glove may be provided in either or both right and left-handed configurations available to a consumer individually or as a pair.

Yet another aspect of the present invention provides for the illumination device to be removably attached to the backside of the half-finger glove via a hook-and-loop fastener assembly comprising a hook fastener strip and a loop fastener strip being integrated on an exterior backside surface of the half-finger glove and the exterior bottom surface of the illumination device, respectively, for removable attachment. The hook fastener strip and a loop fastener strip mate therewith each other in an expected manner. The hook fastener strip may be sewn, integrated, adhered, or otherwise attached thereto the exterior backside surface of the half-finger glove. The loop fastener strip may be integrated, adhered, or otherwise attached thereto the exterior bottom surface of the illumination device. The hook fastener strip engages the loop fastener strip thereby removably attaching the illumination device thereto the half-finger glove. The illumination device is envisioned to be mounted thereupon the half-finger glove and protrudes minimally above the backside surface of said glove thereby reducing the possibility of interference in confined spaces and/or damage during utilization.

Still yet another aspect of the present invention comprises an upper enclosure portion, a plurality of light sources, a lower enclosure portion, and a trim strip. The upper and lower closure portions provide an attachment means to one another being affixed along a mating peripheral edge via respective interlocking and snapping male/female features. The lower enclosure portion is removably attachable to the glove via the loop fastener strip. The enclosure portions comprise a generally rectangular clamshell-shaped structure with rounded borders so as to not present sharp corners that may catch in confined spaces. The enclosure portions comprise a protective and decorative rubber trim strip along a common joining seam.

The upper enclosure portion further comprises a flush-mounted battery compartment along a top surface containing preferably one (1) or more rechargeable batteries being in electrical communication with a plurality of forwardly directed light sources. The light sources comprise a row of equally-spaced light sources. Any number of light sources may be introduced along a forwardly facing portion of the enclosure portions to produce varying illumination effects. The light sources preferably comprise a light emitting diode (LED) light source.

The upper enclosure portion further comprises an ON/OFF switch mounted thereupon being adjacent to the battery compartment which is in electrical communication with the light sources and the batteries. The ON/OFF switch comprises a common alternating on/off push button type device that, when depressed to an "ON" state, electrical power is conducted therefrom the batteries to the light sources. Upon receiving electrical power, the light sources generate a light beam to be emitted at varying distances toward a work area. Further, an indented reflective surface behind the light sources is utilized to reflect the light beam outwardly toward the desired work area. The light sources preferably generate and emit a conical illumination beam through a protective cover such as a lens, to illuminate said work area. The protective cover is transparent; however, may be provided as a translucent element. The light beam is inclined slightly upward relative to the direction of the light sources and the hand member, thus the user may perceive, locate, and/or work in an area that may not typically be illuminated, especially in cramped areas.

Another object of the present invention provides for an alternate full-finger glove embodiment comprising similar construction and materials as the previously described preferred embodiment; however, comprises a full-finger glove portion providing additional protection thereto a user's hand and finger areas when performing tasks involving various possible hazards such as, but not limited to: hot objects, sharp objects, electrified objects, cold weather conditions, harmful chemicals, and the like. The full-finger glove may be provided in either or both right and left-handed configurations being available to a consumer individually or as a pair.

The present invention provides a simple direct current (DC) circuit comprising of one (1) or more rechargeable batteries, a push-button type ON/OFF switch, and four (4) LED light sources. A DC voltage is conducted thereto the ON/OFF switch which is in turn is activated by a user to conduct said voltage thereto a plurality of light sources, thereby emitting the light beam.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | half-finger glove embodiment |
| 15 | hand member |
| 16 | arm member |
| 20 | half-finger glove |
| 25 | elastic wristband |
| 27 | digit opening |
| 30 | illumination device |
| 32 | upper enclosure portion |
| 33 | battery housing |
| 35 | light source |
| 36 | ON/OFF switch |
| 37 | lower enclosure portion |
| 38 | trim strip |
| 40 | light beam |
| 41 | battery compartment |
| 42 | battery |
| 43 | reflective surface |
| 44 | protective cover |
| 50 | hook fastener strip |
| 51 | loop fastener strip |
| 60 | full-finger glove embodiment |
| 65 | full-finger glove |

DETAILED DESCRIPTION OF THE PREFERRED EMBODIMENT

Figure 1:
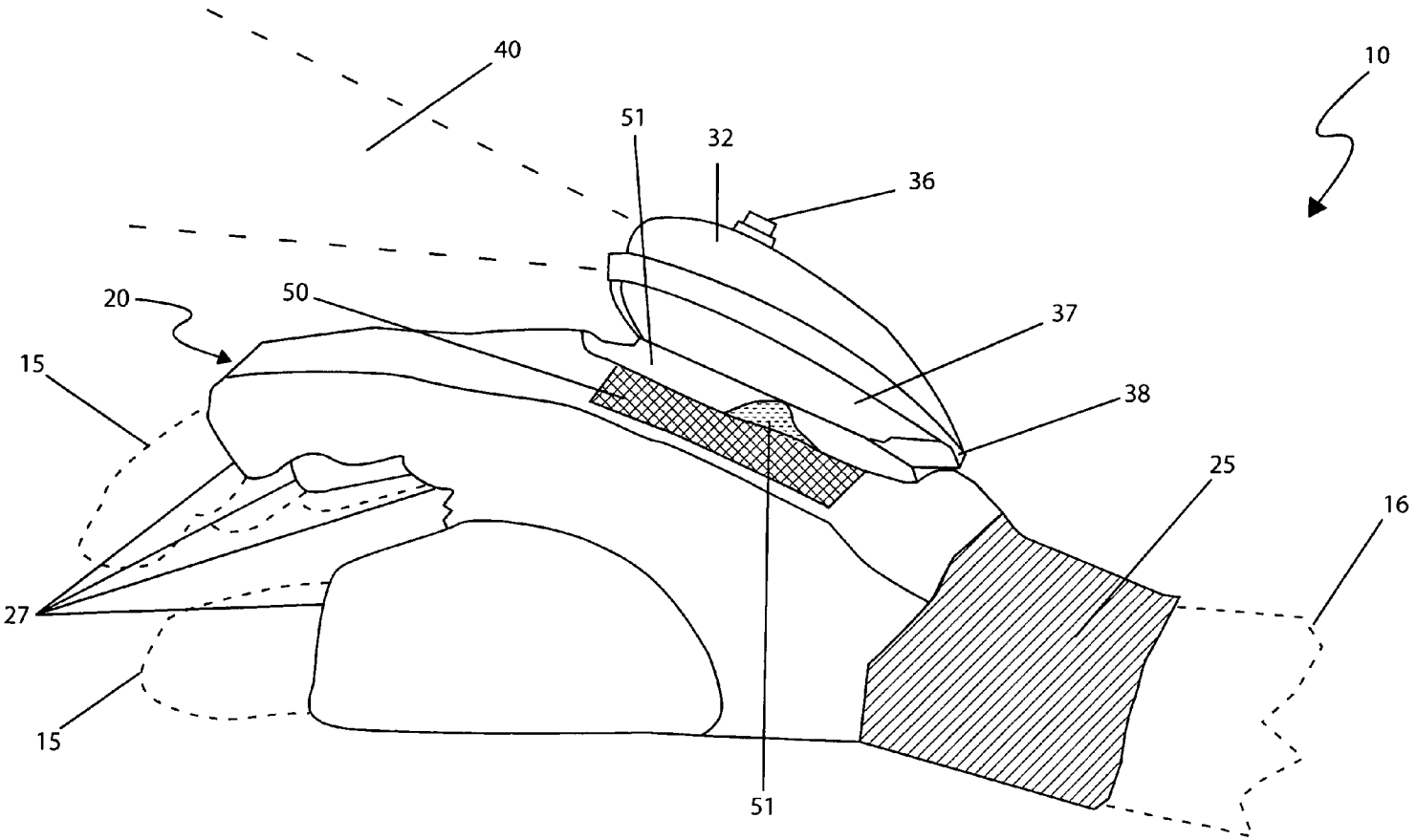
FIG. 1 is a side view of a glove with attached illumination means 10 with a right hand member 15 inserted therethrough, according to the preferred embodiment of the present invention.
Figure 2:
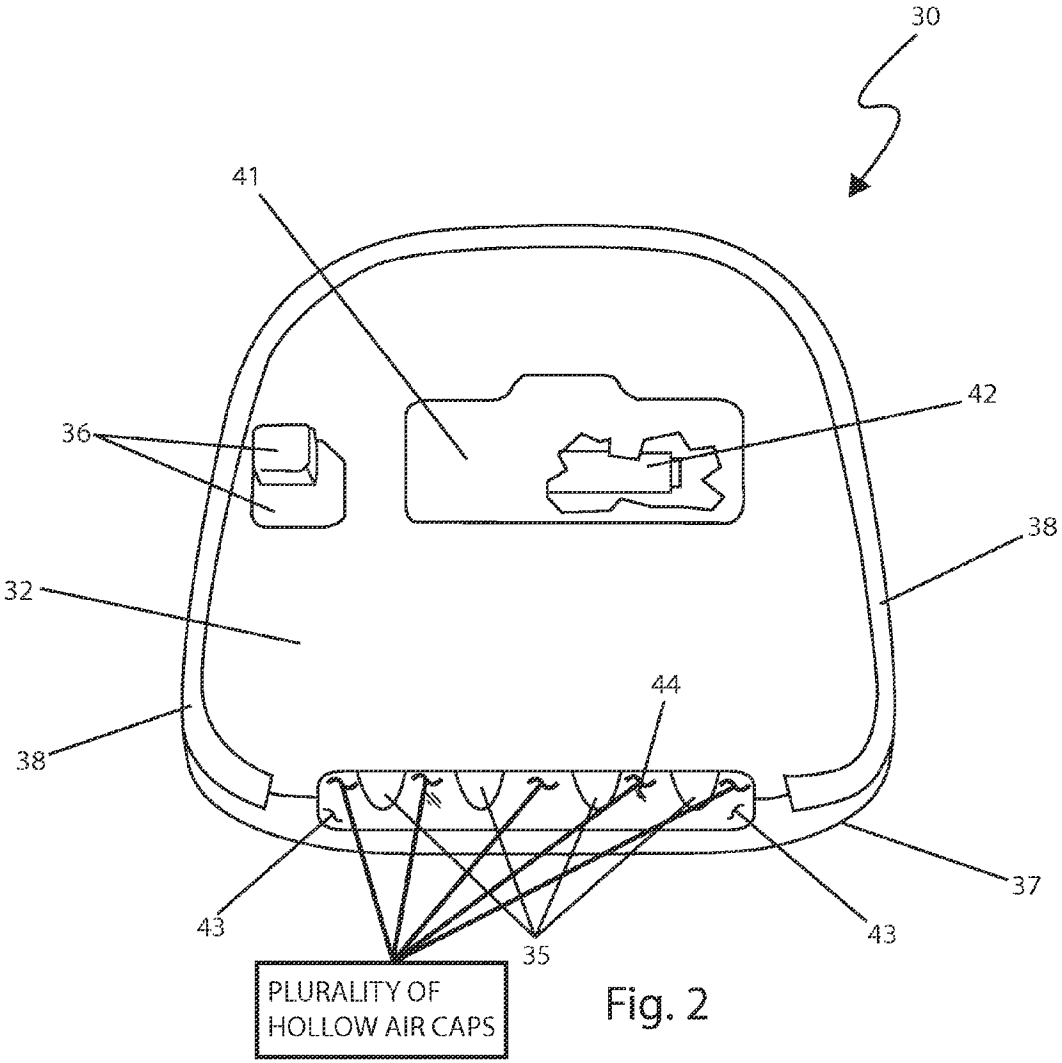
FIG. 2 is a top perspective view of an illumination device portion 30, according to the preferred embodiment of the present invention.
Figure 3:
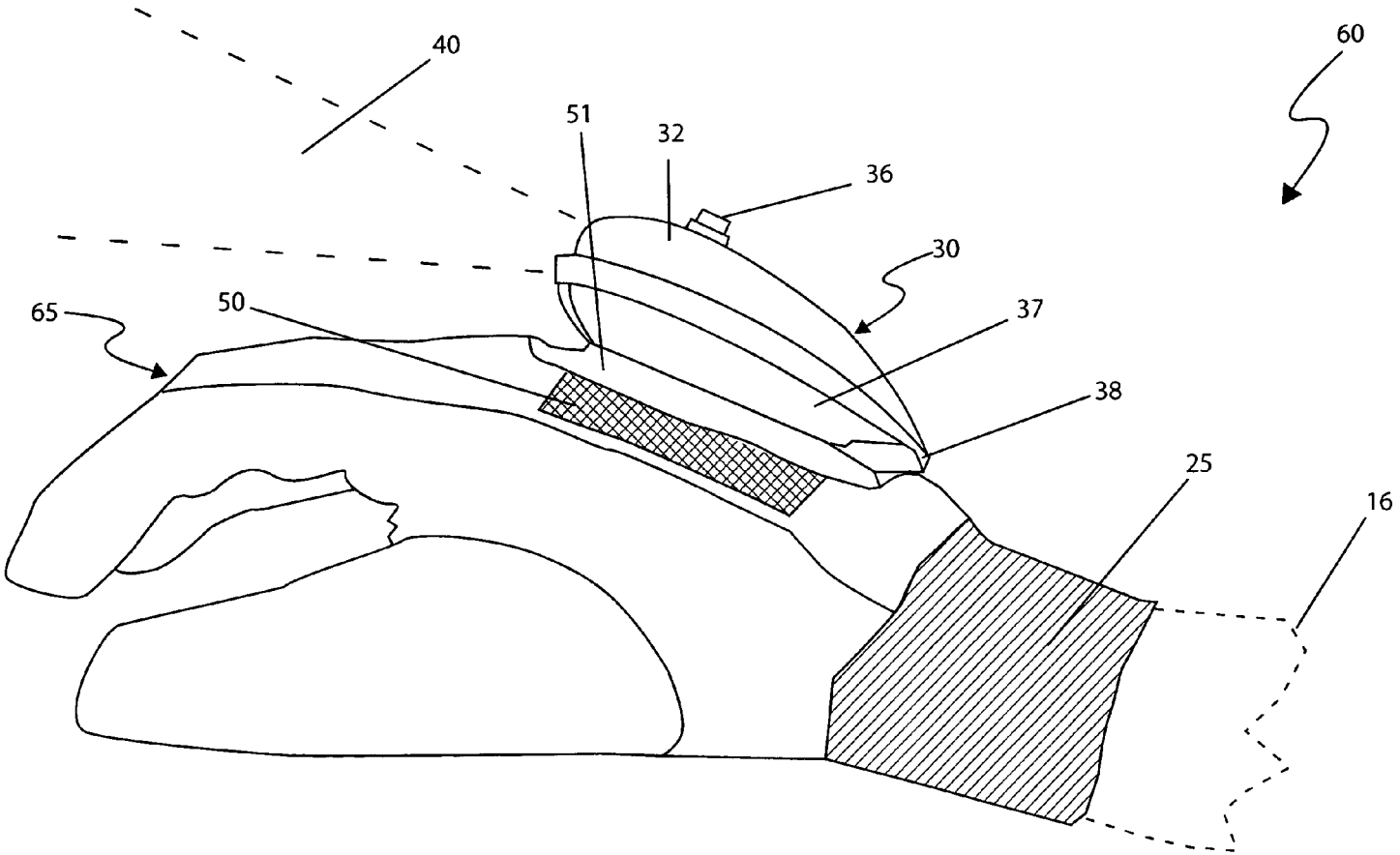
FIG. 3 is a side view of a full-finger glove embodiment 60, according to an alternate embodiment of the present invention; and, FIG. 4 is an electrical block diagram of the illumination device portion 30, according to a preferred embodiment of the present invention.
Figure 4:
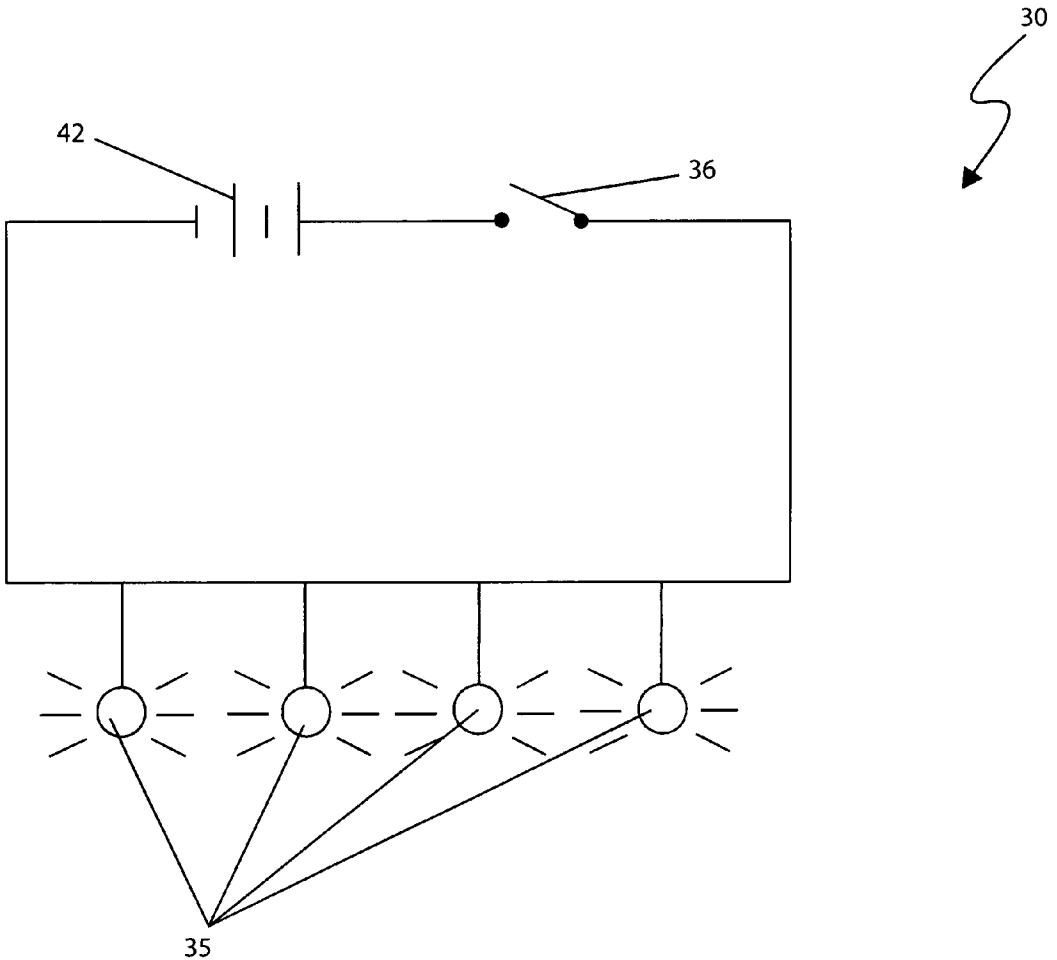

The best mode for carrying out the invention is presented in terms of its preferred embodiment, herein depicted within FIGS. 1, 2 and 4, and in terms of an alternate full-finger glove embodiment, herein depicted in FIG. 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for gloves with attached illumination means (herein described as the "apparatus") 10, comprising a half-finger glove embodiment 20, an alternate full-finger glove embodiment 60, and an illumination device 30 removably attached thereto. The overall enclosure of the illumination device 30 comprises a two-piece "clamshell" design made of plastic in an injection molding process which would require a design and use of custom molds. The illumination device 30 may be supplied with the gloves 20 or individually as a separate kit for adding thereto an existing glove. The glove material 20 is envisioned to be made that of cloth, rubber, or other materials of elastic properties depending on the type of work the user is participating in.

Referring now to FIG. 1, a side view of the apparatus 10 with a right hand member 15 inserted therethrough, according to the preferred embodiment of the present invention, is disclosed. The apparatus 10 comprises a half-finger glove 20 with an affixed illumination device 30. The half-finger glove 20 is envisioned to be shaped in a form of a conventional human hand member 15 comprising five (5) digit areas extending from a central palm and backside areas of the hand member 15. The half-finger glove 20 provides an attachment means thereto an elastic cylindrical-shaped band 25 extending around a user's wrist area having a conventional circular aperture to removably receive a hand member 15 therein. The elastic band 25 comprises a sewn attachment thereto the half-finger glove 20 around a lower perimeter edge using conventional textile sewing techniques snuggly fitting thereagainst the wrist portion of the hand member 15. The half-finger glove 20 provides protection and permits bending movements in conjunction with the user's hand member 15 while providing a taut envelope thereon. The half-finger glove 20 comprises an elastic material allowing stretching for easy insertion of hand members 15 conforming thereto the shape and bending movements of the hand member 15. The half-finger glove 20 comprise digit openings 27 on each end such that the digits of the hand member 15 may extend outwardly therefrom, thus providing enhanced tactile feedback. The half-finger glove 20 is illustrated here in a right-hand configuration; however, it is understood that said half-finger glove 20 may be provided in either or both right and left-handed configurations being available to a consumer individually or as a pair.

The illumination device 30 is removably attached thereto the backside of the half-finger glove 20. In this fashion, the illumination device 30 does not move when the digits move thereby permitting a light beam 40 emitting therefrom to remain on a desired work area while the user is performing a task. The half-finger glove 20 provides an attachment means thereto the illuminating device 30 via a hook-and-loop fastener assembly comprising a hook fastener strip 50 and a loop fastener strip 51 being integrated on an exterior backside surface of the half-finger glove 20 and the exterior bottom surface of the illumination device 30, respectively, for removable attachment. The hook fastener strip 50 and a loop fastener strip 51 mate therewith each other in an expected manner. The hook fastener strip 50 may be sewn, integrated, adhered, or otherwise attached thereto the exterior backside surface of the half-finger glove 20. The loop fastener strip 51, shown here partially turned up for illustration sake, may be integrated, adhered, or otherwise attached thereto the exterior bottom surface of the illumination device 30. It will be appreciated that the positions of the hook fastener strip 50 and the loop fastener strip 51 may be reversed without leaving the scope of the invention 10. The hook fastener strip 50 is affixed thereto the exterior backside surface of the half-finger glove 20 for selectably attaching to the loop strip fastener 51 affixed thereto the central exterior bottom surface of the illumination device 30. The hook fastener strip 50 engages the loop fastener strip 51 thereby removably attaching the illumination device 30 thereto the half-finger glove 20. The illumination device 30 is envisioned to be mounted thereupon the half-finger glove 20 and protrudes minimally above the backside surface of said glove 20 thereby reducing the possibility of interference in confined spaces and/or damage during utilization. It is understood that the illumination device 30 may be supplied with the half-finger glove 20 or may be introduced individually as a separate kit for adding thereto an existing glove at a later date.

Referring now to FIG. 2, a top view of the illumination device portion 30 of the apparatus 10, according to the preferred embodiment of the present invention, is disclosed. The illumination device 30 comprises an upper enclosure portion 32, a plurality of light sources 35, a lower enclosure portion 37, and a trim strip 38. The upper 32 and lower 37 enclosure portions provide an attachment means thereto one another being affixed along a mating peripheral edge via respective interlocking and snapping male/female features. The lower enclosure portion 37 is removably attachable to the glove 20 via the loop fastener strip 51. The enclosure portions 32, 37 comprise a generally rectangular clamshell-shaped structure with rounded borders so as to not present sharp corners that may catch in confined spaces. Said enclosure portions 32, 37 comprise a protective and decorative rubber trim strip 38 along a common joining seam being affixed thereto using methods such as, but not exclusively, mechanical locking features, adhesives, or the like. The upper enclosure portion 32 further comprises a flush-mounted battery compartment 41 along a top surface containing preferably one (1) or more rechargeable batteries 42 being in electrical communication with a plurality of forwardly directed light sources 35. The light sources 35 comprise a row of equally-spaced light sources 35. Said light sources 35 are illustrated here as a grouping of four (4) units; however, any number of light sources 35 may be introduced along a forwardly facing portion of the enclosure portions 32, 37 to produce varying illumination effects. The light sources 35 preferably comprise a light emitting diode (LED) light source; however, other light sources 35 may be utilized in conjunction with or instead of the LED light source such as, but not limited to: fiber optic light source, halogen light source, and/or incandescent light source. The upper enclosure portion 32 further comprises an ON/OFF switch 36 mounted thereupon being adjacent thereto said battery compartment 41 which is in electrical communication with the light sources 35 and the batteries 42. The ON/OFF switch 36 preferably comprises a common alternating on/off push button type device. When the ON/OFF switch 36 is depressed to an "ON" state, electrical power is conducted therefrom the batteries 42 thereto the light sources 35. Upon receiving electrical power, the light sources 35 generate a light beam 40 to be emitted at varying distances toward a work area. Further, an indented reflective surface 43 behind the light sources 35 is utilized to reflect the light beam 40 outwardly toward the desired work area in a bright manner. The light sources 35 preferably generate and emit a conical illumination beam 40 therethrough a protective cover 44, such as a lens, to illuminate said work area. The protective cover 44 is preferably transparent; however, may be provided as a translucent element. The light beam 40 is inclined slightly upward relative to the direction of the light sources 35 and the hand member 15, thus the user may perceive, locate, and/or work in an area that may not typically be illuminated, especially in cramped areas.

Referring now to FIG. 3, a side view of a full-finger glove embodiment 60, according to an alternate embodiment of the present invention, is disclosed. The alternate full-finger glove embodiment 60 comprises similar construction and materials as the previously described preferred embodiment 10; however, comprises a full-finger glove portion 65 providing additional protection thereto a user's hand and finger areas when performing tasks involving various possible hazards such as, but not limited to: hot objects, sharp objects, electrified objects, cold weather conditions, harmful chemicals, and the like. The full-finger glove 65 is illustrated here in a right-hand configuration; however, it is understood that said full-finger glove 65 may be provided in either or both right and left-handed configurations being available to a consumer individually or as a pair.

Referring now to FIG. 4, an electrical block diagram of the illumination device portion 30, according to a preferred embodiment of the present invention, is disclosed. The apparatus 10 provides a simple direct current (DC) circuit comprising of one (1) or more rechargeable batteries 42, a push-button type ON/OFF switch 36, and four (4) LED light sources 35. A DC voltage is conducted thereto the ON/OFF switch 36 which is in turn is activated by a user to conduct said voltage thereto a plurality of light sources 35, thereby emitting the light beam 40 therefrom.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 and 2, or alternately as indicated in FIG. 3.

The method of installing and utilizing the preferred embodiment of the apparatus 10 may be achieved by performing the following steps: placing a fresh set of batteries 42 therein the battery compartment 41 to supply power to the illumination device 30; inserting a hand member 15 therein the half-finger glove 20; securing the illumination device 30 thereupon a top surface of the half-finger glove 20 by engaging the hook fastener strip 50 with the loop fastener strip 51; depressing the ON/OFF switch 36 to activate the light sources 35 so as to emit a light beam 40; and, benefiting from a properly directed and hands-free illumination device 30 afforded a user of the present invention 10.

The method of installing and utilizing the alternate full-finger embodiment 60 may be achieved by performing the same steps as listed above.

The apparatus 10 provides a means to have a light beam 40 without having to hold the illumination device 30 such as in a case of conventional flashlights and trouble lights. The illumination device 30 comprises a two-piece enclosure 32, 37 which further comprises light sources 35, a battery compartment 41, an ON/OFF switch 36, and a reflective surface 43 that is utilized to illuminate an area in front of the respective hand member 15. The light sources 35 are operated by the ON/OFF switch 36 allowing electrical communication therewith said light sources 35 to emit the light beam 40. The illumination device 30 is removably attached thereto a back surface of the half-finger glove 20 to project the light beam 40 toward a work area. In this fashion, the illumination device 30 is securely retained thereupon being isolated therefrom movement transmitted therefrom the finger portions of the hand member 15, thereby providing a steady light beam 40. The illumination device 30 may be affixed interchangably on either or both left or right hand configurations of the half-finger glove 20.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An apparatus for providing an illumination means thereto an adjacent area comprising:

a glove shaped in a form of a conventional hand member and to be worn by a user further comprising:

five (5) digit areas extending from a central palm and a backside surface of said glove and worn on said hand member; and, an attachment means attached thereto an elastic cylindrical-shaped band extending around a user's wrist area having a conventional circular aperture to removably receive said hand member therein;

an illumination device removably attached thereto said backside surface of said glove therewith an attachment means, further comprising:

an upper enclosure portion comprising an upper surface;

a lower enclosure portion matingly attached thereto said upper enclosure portion and creating a common joining seam and comprising a bottom surface;

a front opening of said seam created when said upper enclosure is matingly attached to said lower enclosure portion;

a protective and decorative trim strip attached thereto said common joining seam and extending about a perimeter therealong and terminating prior to said front opening;

a plurality of light sources housed within an interior when said upper enclosure portion is matingly attached to said lower enclosure portion providing an illumination means, further comprising:

said light sources being spaced apart between said upper and lower enclosures such that a plurality of hollow air gaps are juxtaposed between said light sources;

a row of equally-spaced light sources;

an indented reflective surface beneath said plurality of light sources; and, a transparent or translucent protective cover at said front portion to focus and direct said illumination means;

wherein said plurality of light sources generates and emits a conical illumination beam through said protective cover;

wherein said reflective surface reflect said illumination means outwardly toward said desired work area;

a power source; and, a power switch in electrical connection therewith said power source and said plurality of light sources;

wherein said glove provides protection and permits bending movements in conjunction with said hand member while providing a taut envelope thereon;

wherein said illumination device protrudes minimally above said backside surface of said glove thereby reducing interference in confined spaces and/or damage during utilization or manipulation of said apparatus;

wherein said plurality of light sources are directed forward to provide said illumination means; and, wherein said illumination device does not move when said digit areas move thereby permitting a light beam emitting therefrom to remain on a desired work area while said user is performing a task.

2. The apparatus of claim 1, wherein said glove further comprises an elastic material allowing stretching for easy insertion of said hand member conforming thereto a shape and bending movements of said hand member.

3. The apparatus of claim 1, wherein said attachment means comprises a hook-and-loop fastener assembly wherein said hook fastener strip is integrated on said backside surface of said glove and a loop fastener strip is integrated on said bottom surface of said illumination device.

4. The apparatus of claim 1, wherein said upper and lower enclosure portions provide an attachment means thereto one another being affixed along a mating peripheral edge via respective interlocking and snapping male/female features.

5. The apparatus of claim 1, wherein said upper and lower enclosure portions comprise a generally rectangular clamshell-shaped structure with rounded borders so as to not present sharp corners that may catch in confined spaces.

6. The apparatus of claim 1, wherein said trim strip comprises a rubber construction.

7. The apparatus of claim 1, wherein said plurality of light sources is a device form the group consisting of light-emitting diodes (LED); fiber optic lights, halogen lights, and incandescent lights.

8. The apparatus of claim 1, wherein said power source further comprises at least one battery removably placed therein a flush-mounted battery compartment along said upper surface of said illumination device.

9. The apparatus of claim 1, wherein said power switch further comprises an ON/OFF switch mounted thereupon said upper surface of said illumination device, wherein when said ON/OFF switch is depressed to an "ON" state, electrical power is conducted therefrom said power source thereto said plurality of light sources for generating and emitting said illumination means.

10. The apparatus of claim 1, wherein said glove may be provided in either or both right-handed and left-handed configurations.

11. The apparatus of claim 10, wherein said glove is a half-finger glove.

12. The apparatus of claim 10, wherein said glove is a full-finger glove.

13. An apparatus for providing an illumination means thereto an adjacent area comprising:

a glove shaped in a form of a conventional hand member and to be worn by a user further comprising:

five (5) digit areas extending from a central palm and a backside surface of said glove and worn on said hand member; and, an attachment means thereto an elastic cylindrical-shaped band extending around a user's wrist area having a conventional circular aperture to removably receive said hand member therein;

an illumination device removably attached thereto said backside surface of said glove therewith an attachment means, further comprising:

a generally rectangular clamshell-shaped structure with rounded borders comprising an upper enclosure portion having an upper surface, a lower enclosure portion matingly attached thereto said upper enclosure portion via respective interlocking and snapping male/female features and creating a common joining seam and having a bottom surface, a front opening of said seam created when said upper enclosure is matingly attached to said lower enclosure portion, and a protective and decorative rubber trim strip attached thereto said common joining seam and extending about a perimeter therealong and terminating prior to said front opening;

a plurality of LED light sources housed within said structure providing an illumination means, further comprising:

said light sources being spaced apart between said upper and lower enclosures such that a plurality of hollow air gaps are juxtaposed between said light sources;

a row of equally-spaced LED light sources;

an indented reflective surface beneath said plurality of light sources; and, a transparent or translucent protective cover at said front portion to focus and direct said illumination means;

wherein said plurality of LED light sources generates and emits a conical illumination beam through said protective cover;

wherein said reflective surface reflect said illumination means outwardly toward said desired work area;

a power source removably located therein a flush-mounted battery compartment along an upper surface of said upper enclosure portion; and, a power switch in electrical connection therewith said power source and said plurality of light sources and mounted thereon said upper surface of said upper enclosure portion;

wherein said glove provides protection and permits bending movements in conjunction with said hand member while providing a taut envelope thereon;

wherein said illumination device protrudes minimally above said backside surface of said glove thereby reducing interference in confined spaces and/or damage during utilization or manipulation of said apparatus;

wherein said plurality of light sources are directed forward to provide said illumination means; and, wherein said illumination device does not move when said digit areas move thereby permitting a light beam emitting therefrom to remain on a desired work area while said user is performing a task.

14. The apparatus of claim 13, wherein said glove further comprises an elastic material allowing stretching for easy insertion of said hand member conforming thereto a shape and bending movements of said hand member.

15. The apparatus of claim 13, wherein said attachment means comprises a hook-and-loop fastener assembly wherein said hook fastener strip is integrated on said backside surface of said glove and a loop fastener strip is integrated on said bottom surface of said illumination device.

16. The apparatus of claim 13, wherein said glove may be provided in either or both right-handed and left-handed configurations.

17. The apparatus of claim 16, wherein said glove is a half-finger glove.

18. The apparatus of claim 16, wherein said glove is a full-finger glove.

* * * * *